US007654409B2

(12) United States Patent
Hoffmann

(10) Patent No.: US 7,654,409 B2
(45) Date of Patent: Feb. 2, 2010

(54) SHOPPING BAG STORAGE AND DISPENSING UNIT

(76) Inventor: Roy W. Hoffmann, 5 Benson La., Fair Haven, VT (US) 05743

( * ) Notice: Subject to any disclaimer, the term of this patent is extended or adjusted under 35 U.S.C. 154(b) by 199 days.

(21) Appl. No.: 12/070,302

(22) Filed: Feb. 19, 2008

(65) Prior Publication Data

US 2009/0206091 A1 Aug. 20, 2009

(51) Int. Cl.
*B65D 1/24* (2006.01)
*B65D 6/40* (2006.01)

(52) U.S. Cl. ..... 220/553; 220/480; 220/661; 206/554

(58) Field of Classification Search ..... 220/476, 220/480, 500, 523, 553, 601, 676, 661; 206/233, 206/554; 221/45, 56, 303; 211/85.15; 248/213.2
See application file for complete search history.

(56) References Cited

U.S. PATENT DOCUMENTS

| | | | | |
|---|---|---|---|---|
| 5,042,687 | A * | 8/1991 | McKinley | 221/311 |
| 5,570,808 | A * | 11/1996 | Tassoni | 221/34 |
| 5,595,129 | A * | 1/1997 | Grobe | 109/22 |
| 2004/0060941 | A1 * | 4/2004 | Middione et al. | 220/661 |
| 2006/0231558 | A1 * | 10/2006 | Gayman | 220/476 |

* cited by examiner

*Primary Examiner*—Harry A Grosso
(74) *Attorney, Agent, or Firm*—John J. Welch, Jr, Esq.

(57) ABSTRACT

A shopping bag storage and dispensing unit consisting of a topwise open box component, a partition component therein, a hole in the front side thereof, a hole in the backside thereof, a lid component fittable over the top edging of the box component, two holes in the lid component each being amenable to receipt of a dagger component, as well as a support bracket receivable by the backside hole, with holes in the support bracket for receipt of affixation members in turn receivable by a vertically inclined hard surface and pieces of hook and fastener material affixable to one another as well as to the vertically inclined hard surface and to the backside of the box component respectively.

6 Claims, 9 Drawing Sheets

SHOPPING BAG STORAGE AND DISPENSING UNIT

CROSS REFERENCES TO PRIOR OR PARENT APPLICATIONS

There are no prior or parent applications to which the invention relates.

FEDERALLY SPONSORED RESEARCH AND DEVELOPMENT

There is no federally sponsored research and development to which the invention relates.

BACKGROUND OF THE INVENTION

1. Field of the Invention

The invention is one of those sorts of devices serving for the storage and dispensing of shopping bags.

2. Related Art

The art disclosed in the Information Disclosure Statement herewith submitted relates to but does not anticipate the invention.

A SUMMARY OF THE INVENTION

1. A Brief Description of the Invention

The invention consists of a box component. Within the box component is a partition component extending from the bottomside to the top edge of the box component. A first hole is located in the frontside of the box component near the bottomside thereof. Another second hole is located in the backside of the box component near the top edging thereof. The first hole serves to facilitate one's grabbing onto one of the shopping bags located in the frontal compartment portion of the box component. The second hole serves to receive the frontal portion of a support bracket that facilitates a holding of the invention as against a vertically inclined surface. Hook and fastener material affixed to the backside of the box component below the level of the second hole operates to further hold the invention against such a vertically inclined surface. A removable lid component fits over and about the open top portion of the box component. A first lid hole and a second lid hole are located in the topside of the lid component. A dagger component is insertable into either the first lid hole or the second lid hole for the purpose of compressing shopping bags held within either the frontal compartment or the rear compartment of the box component. The rear compartment is amenable to being lined with a shopping bag that in turn receives crumpled up and compressed other shopping bags. When the liner bag is completely full of compressed shopping bags, some of the compressed bags can be placed within the frontal compartment. If the frontal compartment is too full of bags, then, the liner bag and any remnant contents within the rear compartment can simply be discarded.

2. Objects of the Invention

The invention provides a very handy and convenient means for storing and dispensing shopping bags, typically plastic shopping bags for use in and around a person's home. When a person comes home after grocery shopping with grocery products in plastic shopping gags, instead of simply discarding the bags after having emptied them, the bags can be readily placed within the box component of the invention for utilization at a later point in time for such purposes around the home as, for example, carrying sandwiches to work, carrying crafts to a sewing club get together or even for purposes of perhaps later, simply beridding the home of various and sundry trash items.

For the foregoing reasons, the invention is not only new and unique but unquestionably also useful.

A DESCRIPTION OF THE DRAWINGS

A DESCRIPTION OF THE PREFERRED EMBODIMENT

Figure 1:
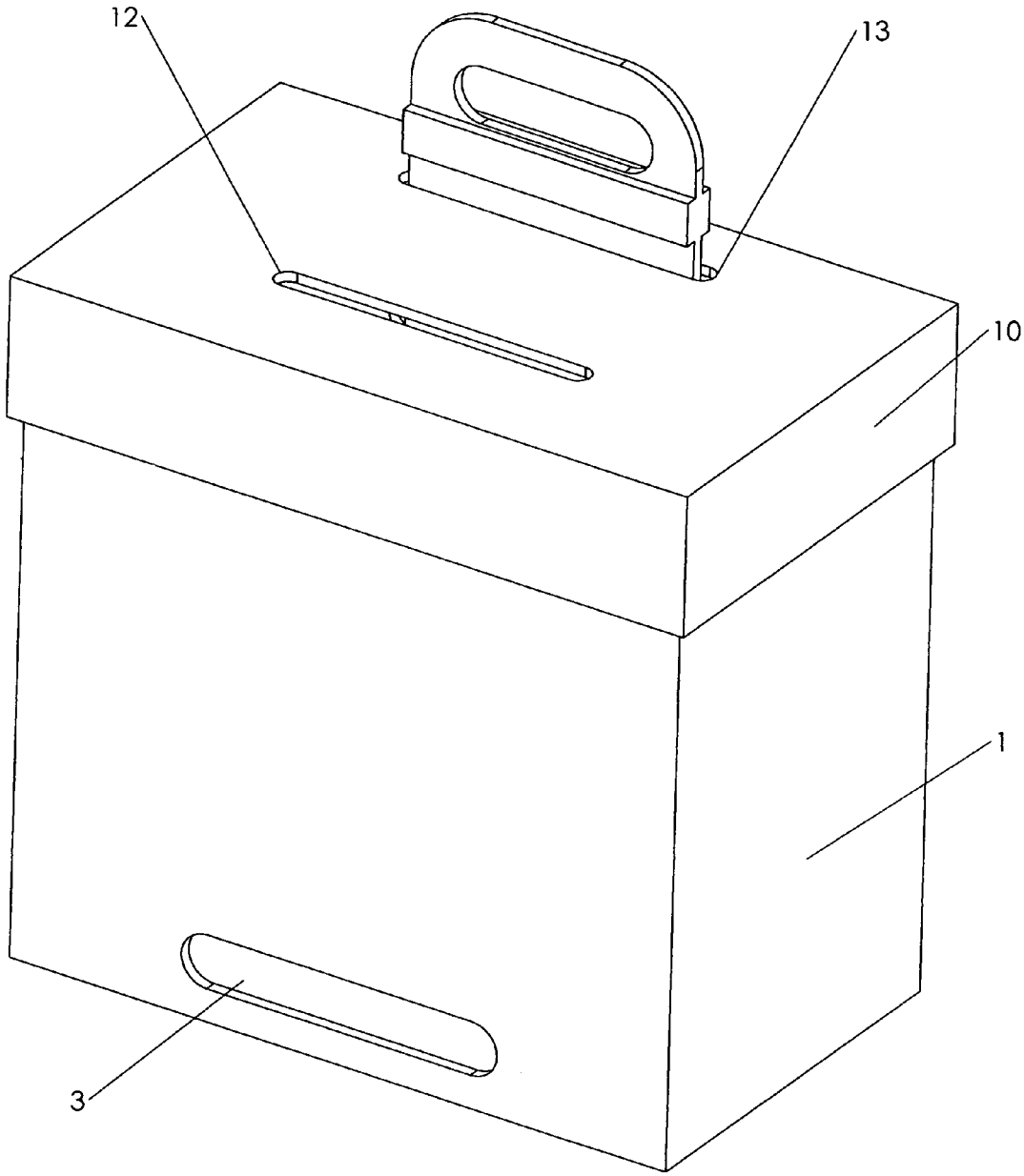
FIG. 1 is a frontally oriented perspective view of the intact invention.
Figure 2:
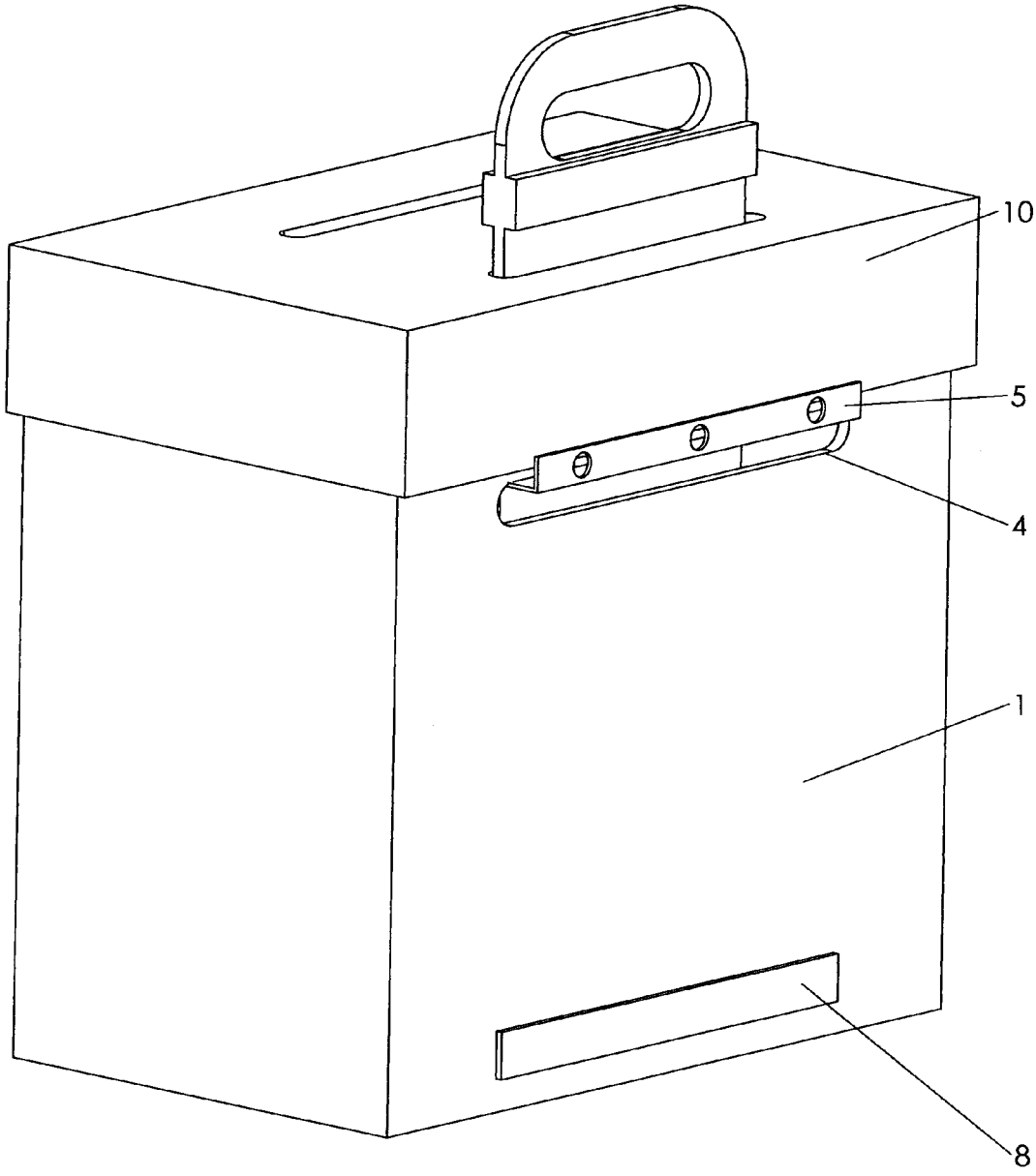
FIG. 2 is a posteriorly oriented perspective view of the intact invention.
Figure 3:
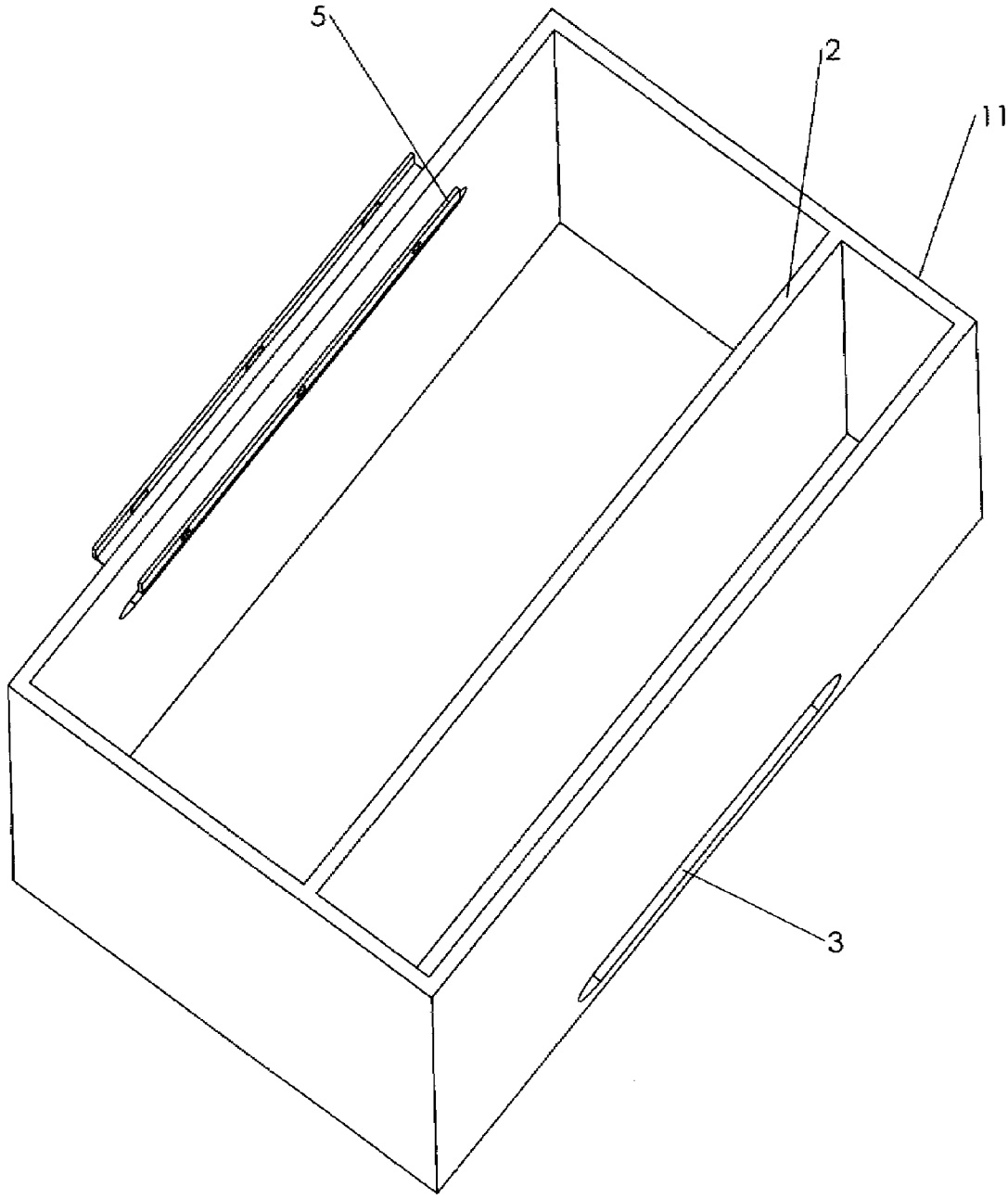
FIG. 3 is a top oriented perspective view of the box component of the invention.
Figure 4:
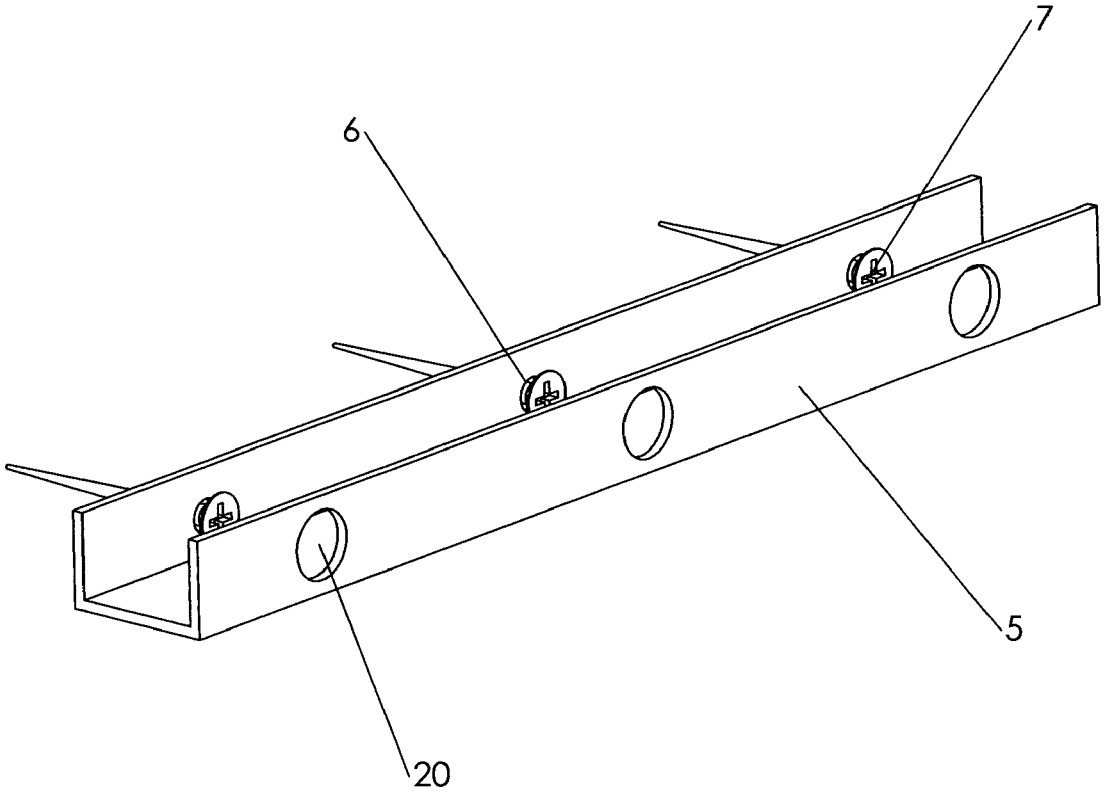
FIG. 4 is an isolated perspective view of the support bracket component of the invention.
Figure 5:
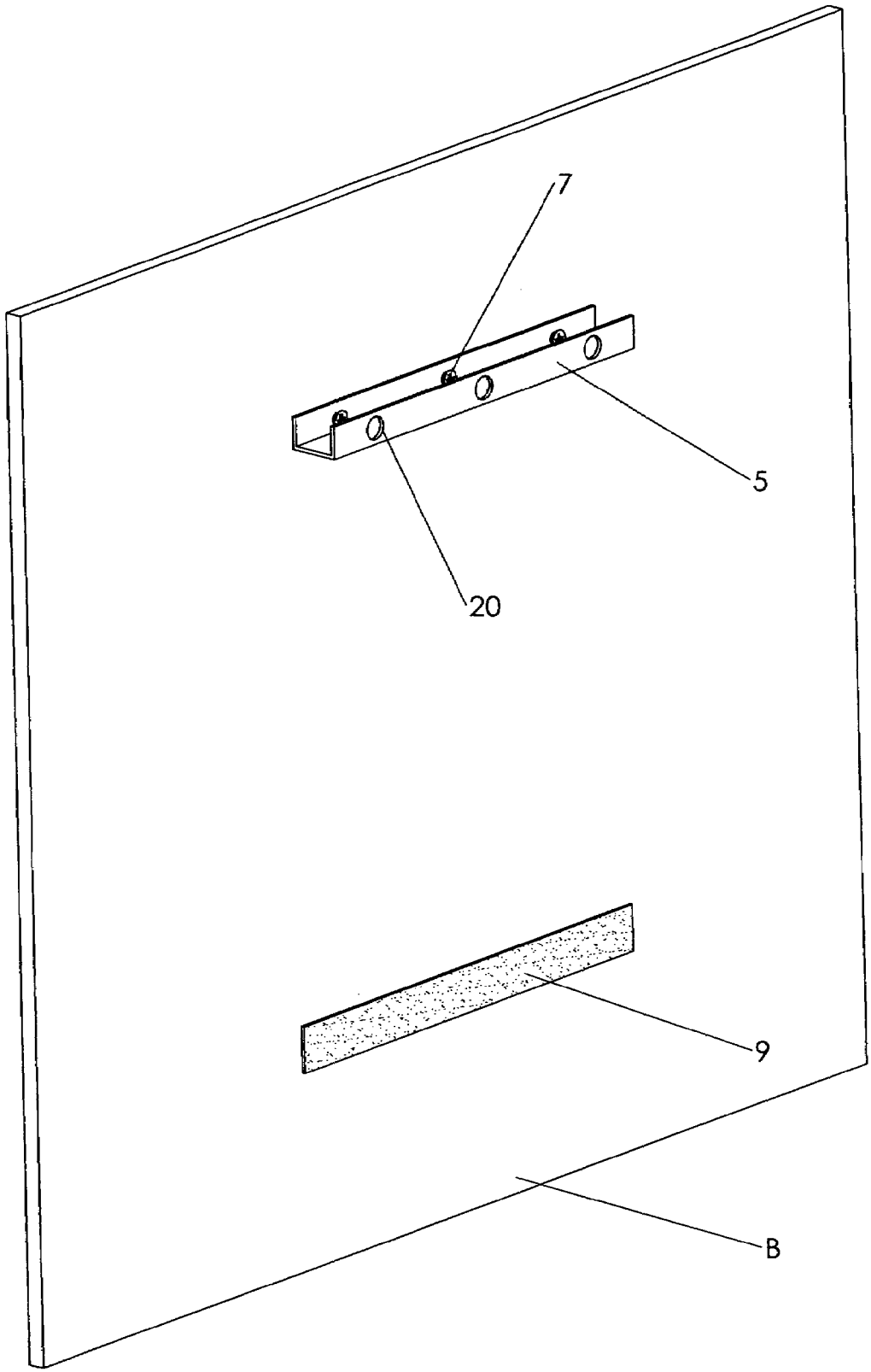
FIG. 5 is an isolated perspective view of the support bracket fastened to a vertically inclined surface.
Figure 6:
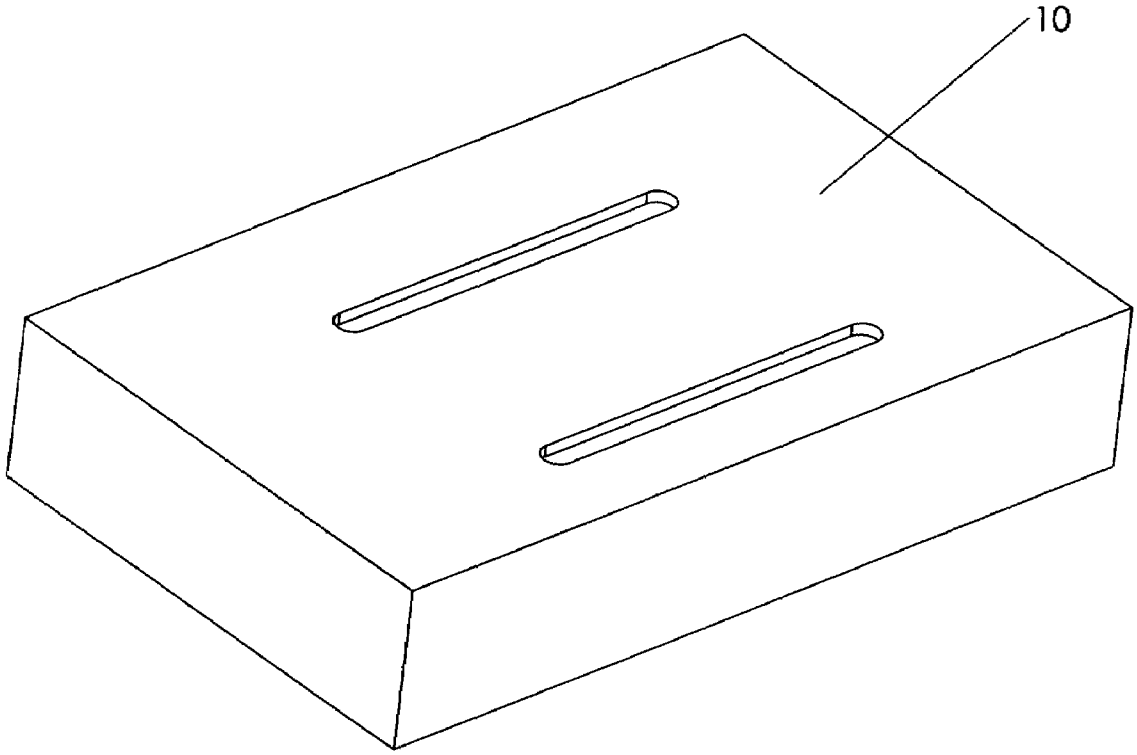
FIG. 6 is an isolated perspective view of the lid component of the invention.
Figure 7:
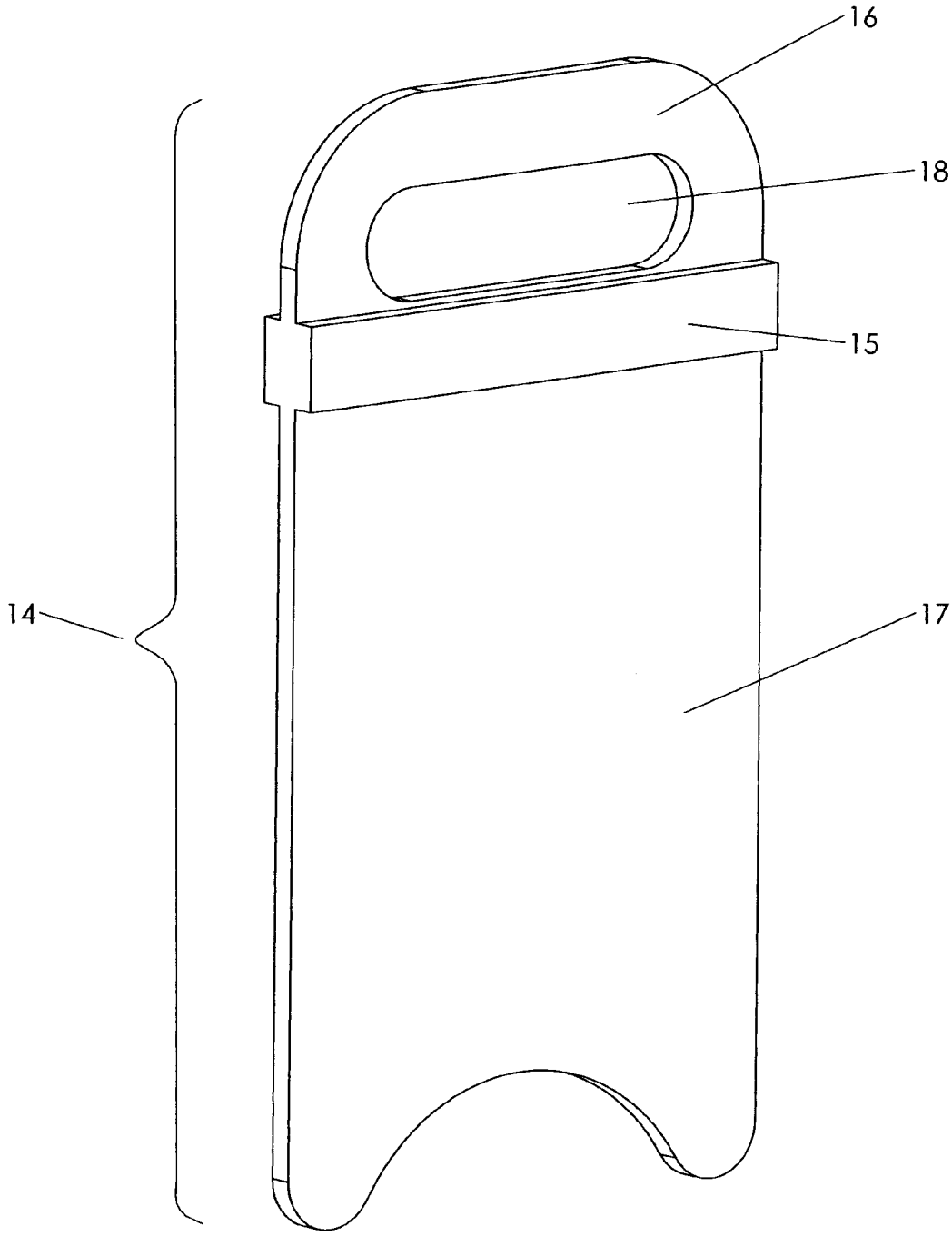
FIG. 7 is an isolated perspective view of the dagger component of the invention.
Figure 8:
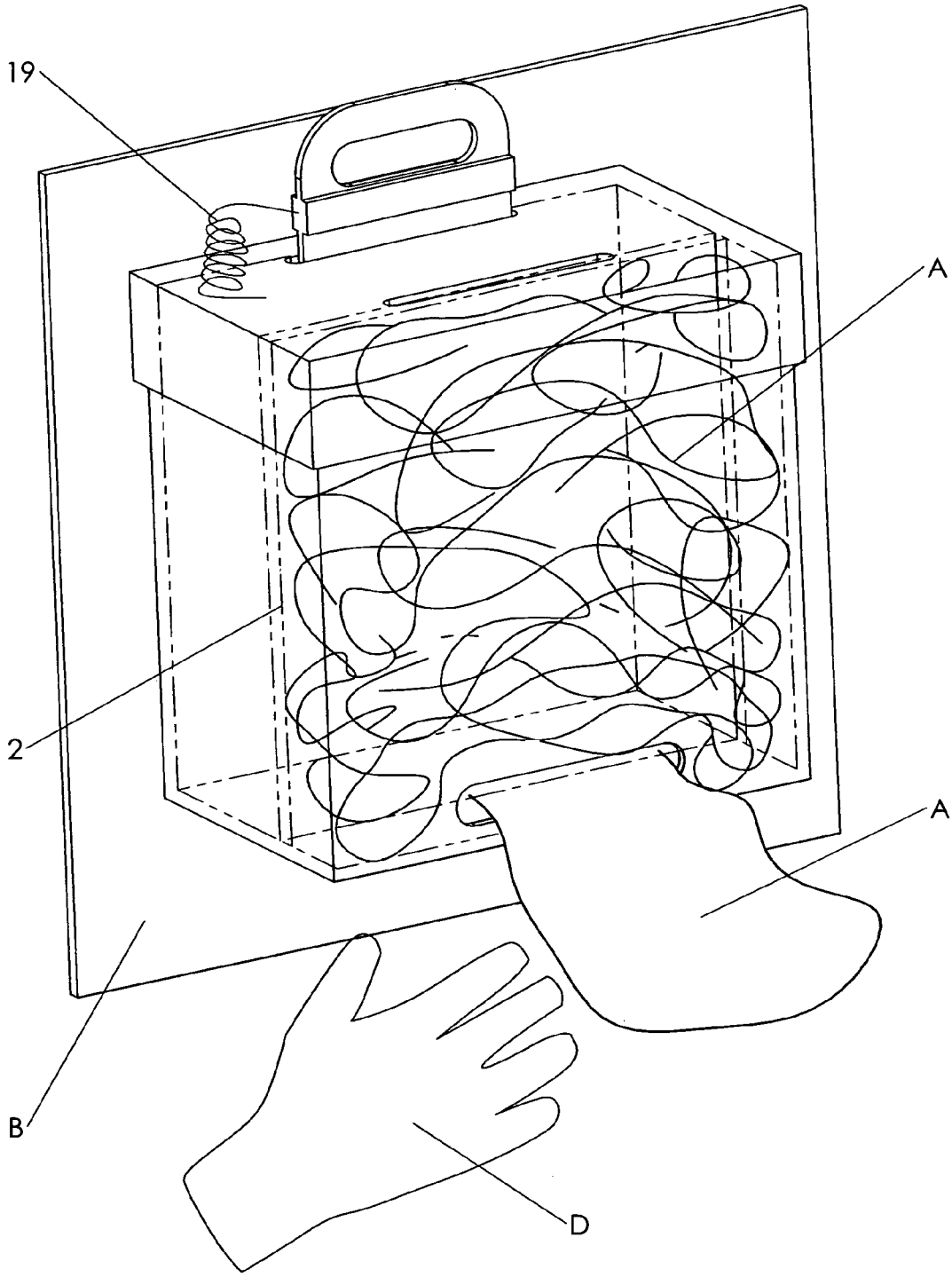
FIG. 8 is a perspective view depicting the invention full of shopping bags affixed to a vertically inclined surface.
Figure 9:
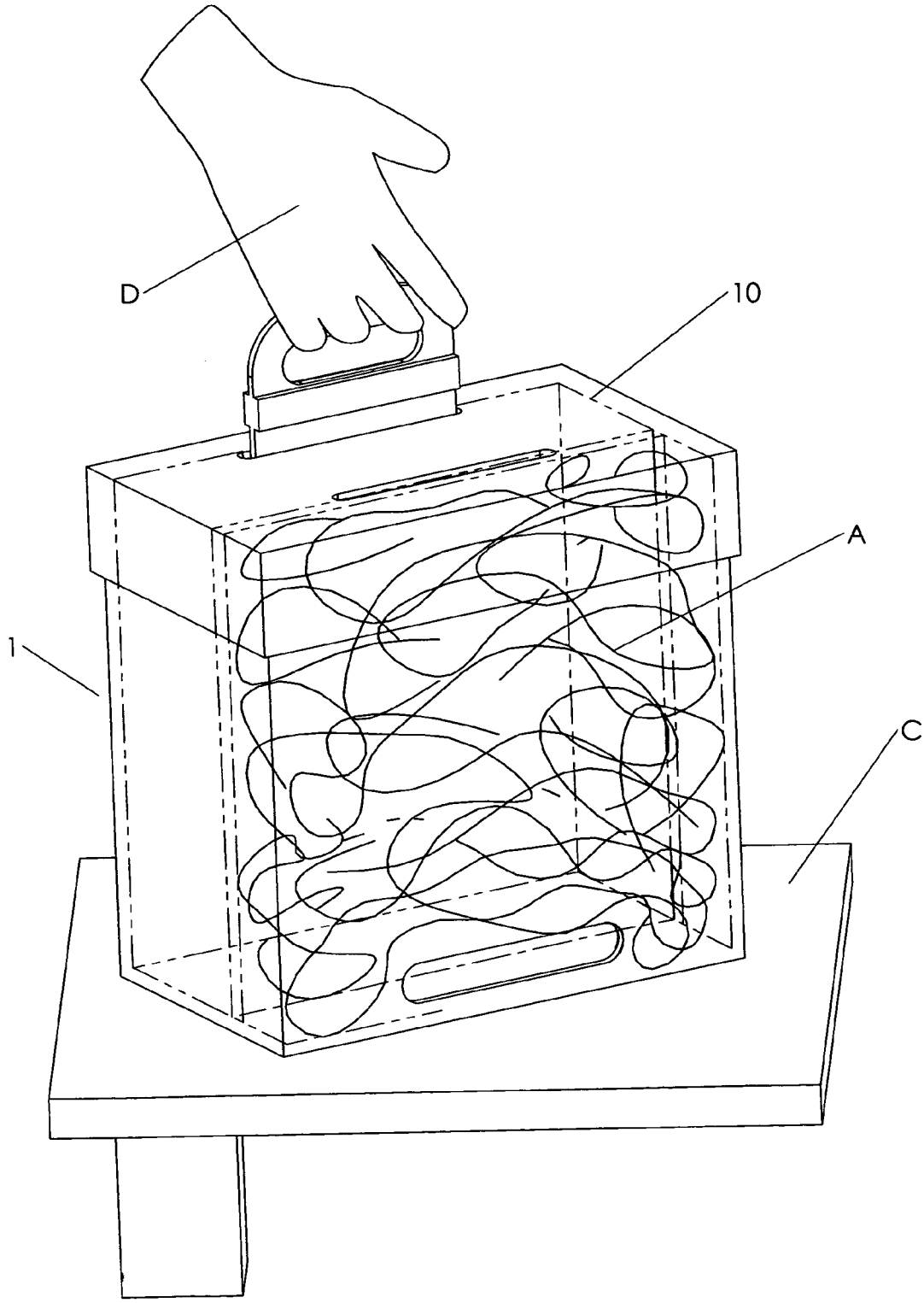
FIG. 9 is a perspective view depicting the invention full of shopping bags and resting on a tabletop.

FIG. 1 discloses the intact invention. Box component 1 is therein shown covered by lid component 10. First lid hole 12, second lid hole 13 and first hole 3 are also therein shown. FIG. 2 also discloses the intake invention, but from behind. Second hole 4 is therein shown as well as support bracket 5. First piece of hook and fastener material 8 is also therein shown. FIG. 3 shows box component 1 in an uncovered state. Support bracket 5 being three sides is thereon shown inserted into hole 4. Top edging 11 and partition component 2 affixed to lateral sides and the bottomside of box component 1 are likewise therein shown. FIG. 4 illustrates in isolated view, three sided support bracket 5 as well as through holes 6 receiving affixation members 7 and access holes 20. FIG. 5 evidences the manner in which support bracket 5 is affixed to vertical walling B by way of inserting affixation members 7, typically screws through access holes 20 to then be affixed through, through holes 6 into walling B. Also shown in FIG. 5 is second piece of hook and fastener material 9 affixed to walling B. FIG. 6 is an isolated view of lid component 10 previously shown in FIG. 1. FIG. 7 shows in isolation, dagger component 14, partially seen in FIG. 1. Also seen in FIG. 7 are dagger stop 15, the upper portion 16 of dagger component 14, the grappling hole 18 therein as well as the elongated lower portion 17 thereof. FIG. 8 shows, inter alia, wiring 19 serving to hold dagger 14 to lid component 10. FIGS. 8 and 9 evidence the manner of operation of the invention either affixed to walling B as shown in FIG. 8 or merely resting on a table top C as shown in FIG. 9. The invention can be mounted to walling B by inserting three sided support bracket through hole 4 as illustrated in FIG. 2 and FIG. 3 after having first mounted bracket 5 to walling B as shown in FIG. 5 and likely by correlatively causing first piece of hook and fastener material 8 seen in FIG. 2 to be affixed to second piece of hook and fastener material 9 once second piece 9 is itself affixed to walling B as seen in FIG. 5. The invention either mounted as per FIG. 8 or unmounted as per FIG. 9 is utilized as follows. A person D causes used plastic shopping bags A to be placed into the anterior one of the compartments formed by virtue of the presence of partition component 2 in box component 1, all as can be appreciated with references to FIGS. 3, 8 and 9. Placement therein of bags A occurs via causing dagger component 14 to be grabbed via grappling hole 18 to then press bags A through first lid hole 12 to then remain in the anterior compartment. Whenever, one of bags A is later sought to be utilized to, for example, carry a couple of sandwiches for lunch, a person D simply pulls one of the bags A through first hole 3 as can be seen in FIG. 8 to utilize the bag A for such a purpose. Insertion of an excess supply of bags A into the posterior compartment of box component 1 behind partition component 2 is accomplished by likewise causing lid component 10 to be placed over top edging 11 of box component 1 and then pressing such excess bags via dagger component 14 through second lid hole 13 into the posterior component. Grappling hole 18 in upper portion 16 of dagger component 14 renders dagger component 14 very easy to use for such purposes. Dagger stop 15 located just below upper portion 16 and just above elongated portion 17 of dagger component 14 serves to ensure that dagger component 14 fits through lid holes 12 or 13 only sufficiently enough to enable elongated lower portion 17 thereof to indeed efficaciously compress bags A appropriately into either the anterior or posterior compartments of box component 1. The breadth of dagger stop 15 is greater than the breadth of either hole 12 or hole 13 in order to ensure the occurrence of such an effect. The invention can be utilized while resting on a table top C as shown in FIG. 9 or it can be used after mounting it, for example, to the inside of a kitchen cupboard door, then becoming the equivalent of vertically inclined walling B via the insertion of affixation members 7, for instance, screws through access holes 20 of three sided support bracket 5 to then be affixed to such vertical walling B through, through holes 6 and then by placing mounted bracket 5 into hole 4 as per FIG. 3 as well as causing first piece of hook and fastener material 8 to become adhered to second piece 9 hook and fastener material 9 as would have been already previously mounted to walling B below the level of mounted bracket 5 all as can be seen and appreciated with reference, once again, to FIGS. 2 and 8. Wiring means 19 attached at one end thereof to dagger component 14 and at the other end to the top surface of lid component 10 is an optional feature of the invention serving to ensure that dagger component 14 does not become inadvertently separated from the remnant components of the instant invention.

Much is being made these days of the need to recycle and preserve plastic shopping bags as a means of protecting and preserving the environment. Legal steps in such regards are currently being taken within China. Public awareness campaigns in such respects are taking place as well, in, for instance, New York City. In view of these facts, once again, respectfully submitted, the invention is unquestionably useful as well as being notably new and unique.

What is claimed is:

1. A shopping bag storage and dispensing unit, comprising:

a. a box component;

b. said box component being topwise open;

c. a partition component affixed to each of two lateral sides and a bottomside of said box component;

d. a first hole being cut into a frontside of said box component near said bottomside thereof;

e. a second hole being cut into a backside of said box component near top edging thereof;

f. a three-sided support bracket;

g. a plurality of through holes cut into a frontside and into a backside of said support bracket;

h. a plurality of affixation members;

i. each one of said plurality of affixation members being receivable by any one of said plurality of through holes;

j. said frontside of said support bracket being receivable by said second hole;

k. a first piece of hook and fastener material being affixed to said backside of said box component below the locus of said second hole;

l. a second piece of hook and fastener material being affixable to said first piece and any vertically inclined walling surface;

m. a lid component affixable over and about said top edging of said box component;

n. a first lid hole being cut into said lid component;

o. a second lid hole being cut into said lid component;

p. a dagger component;

q. a dagger stop constructed about said dagger component;

r. an upper portion of said dagger component located superior to said dagger stop;

s. a grappling hole located in said upper portion;

t. an elongated lower portion of said dagger component located inferior to said dagger stop, and;

u. said dagger component being insertable into said first lid hole or said second lid hole up to a level of said dagger stop.

2. The shopping bag storage and dispensing unit of claim 1, whereby elongated wiring means is affixed at one end thereof to said dagger component and at a second end thereof to said lid component.

3. A shopping bag storage and dispensing unit, comprising:

a. a box component;

b. said box component being topwise open;

c. a partition component affixed to each of two lateral sides and a bottomside of said box component;

d. a first hole being cut into a frontside of said box component near said bottomside thereof;

e. a lid component affixable over and about top edging of said box component;

f. a first lid hole being cut into said lid component;

g. a second lid hole being cut into said lid component;

h. a dagger component;

i. a dagger stop constructed about said dagger component;

j. an upper portion of said dagger component located superior to said dagger stop;

k. a grappling hole located in said upper portion;

l. an elongated lower portion of said dagger component located inferior to said dagger stop, and;

m. said dagger component being insertable into said first lid hole or said second lid hole up to a level of said dagger stop.

4. The shopping bag storage and dispensing unit of claim 3, whereby elongated wiring means is affixed at one end thereof to said dagger component and at a second end thereof to said lid component.

5. A shopping bag storage and dispensing unit, comprising:

a. a box component;

b. said box component being topwise open;

c. a partition component affixed to each of two lateral sides and a bottomside of said box component;

d. a first hole being cut into a frontside of said box component near said bottomside thereof;

e. a second hole being cut into a backside of said box component near top edging thereof;

f. a first piece of hook and fastener material being affixed to said backside of said box component below the locus of said second hole;

g. a second piece of hook and fastener material being affixable to said first piece and any vertically inclined walling surface;

h. a lid component affixable over and about said top edging of said box component;

i. a first lid hole being cut into said lid component;

j. a second lid hole being cut into said lid component;

k. a dagger component;

l. a dagger stop constructed about said dagger component;

m. an upper portion of said dagger component located superior to said dagger stop;

n. a grappling hole located in said upper portion;

o. an elongated lower portion of said dagger component located inferior to said dagger stop, and;

p. said dagger component being insertable into said first lid hole or said second lid hole up to a level of said dagger stop.

6. The shopping bag storage and dispensing unit of claim 5, whereby elongated wiring means is affixed at one end thereof to said dagger component and at a second end thereof to said lid component.

* * * * *